US010786078B2

(12) United States Patent
Kawasawa

(10) Patent No.: US 10,786,078 B2
(45) Date of Patent: Sep. 29, 2020

(54) PHONOGRAPHIC RECORD DISPLAY CASE APPARATUS

(71) Applicant: Adam Takashi Kawasawa, Huntington Beach, CA (US)

(72) Inventor: Adam Takashi Kawasawa, Huntington Beach, CA (US)

( * ) Notice: Subject to any disclaimer, the term of this patent is extended or adjusted under 35 U.S.C. 154(b) by 0 days.

(21) Appl. No.: 16/292,697

(22) Filed: Mar. 5, 2019

(65) Prior Publication Data

US 2019/0269241 A1 Sep. 5, 2019

Related U.S. Application Data

(60) Provisional application No. 62/638,927, filed on Mar. 5, 2018.

(51) Int. Cl.

| | |
|---|---|
| ***B65D 85/57*** | (2006.01) |
| ***A47B 81/06*** | (2006.01) |
| ***A47F 7/03*** | (2006.01) |

(52) U.S. Cl.

CPC ..... *A47B 81/067* (2013.01); *A47B 81/065* (2013.01); *A47F 7/03* (2013.01); *B65D 85/544* (2013.01)

(58) Field of Classification Search

CPC ..... A47B 81/067; A47B 81/065; A47F 7/03; G11B 33/0411; G11B 33/0427; G11B 33/0433; G11B 33/0444; G11B 33/045; G11B 33/0455; G11B 33/0477; G11B 33/0483; G11B 33/04; B65D 85/544

See application file for complete search history.

(56) References Cited

U.S. PATENT DOCUMENTS

| | | | | | |
|---|---|---|---|---|---|
| 3,107,783 | A * | 10/1963 | Corey | B65D 85/544 | 206/310 |
| 4,702,369 | A * | 10/1987 | Philosophe | G11B 33/0427 | 206/308.1 |
| 5,477,961 | A * | 12/1995 | Taniyama | G11B 33/0427 | 206/308.1 |
| 5,533,614 | A * | 7/1996 | Walker | G11B 33/045 | 206/308.1 |
| 5,931,294 | A * | 8/1999 | Weingarden | G11B 33/0427 | 206/308.1 |
| 6,070,721 | A * | 6/2000 | Levitan | A47G 1/162 | 206/232 |
| 7,357,249 | B1 * | 4/2008 | Weber | G09F 3/02 | 206/308.1 |
| 2008/0110071 | A1 * | 5/2008 | Farnsworth | G11B 33/0422 | 40/722 |

* cited by examiner

*Primary Examiner* — Cassandra Davis
(74) *Attorney, Agent, or Firm* — Jerry Joseph

(57) ABSTRACT

A display case apparatus for selectively displaying a phonograph record or album cover including a base member having a recess member formed therein, a display panel member detachably coupled within the recess member of the base member, a spindle member detachably coupled to the display panel member, the spindle member having a first side having a protrusion configured to fit within a hole of the phonograph record and a second opposing side having a planar surface configured to receive the album, and a cover member detachably coupled to the base member to protect items disposed on the spindle member.

6 Claims, 15 Drawing Sheets

PHONOGRAPHIC RECORD DISPLAY CASE APPARATUS

BACKGROUND OF THE INVENTION

1. Field of the Invention

The present general inventive concept relates to display cases for displaying planar items having a central aperture, such as phonograph albums and records, and more particularly, to a display case for selectively displaying a flat item with a circular opening, such as a phonographic record, and a flat item without a circular opening, such as a phonographic record album cover, sleeve or booklet.

2. Background

Phonographic record collectors generally prefer the sound, artwork, and tactile experience associated with phonographic records and their corresponding record covers. Many phonographic record collectors choose to display choice records on the walls of their living spaces, work spaces, and places of business. The phonographic records are generally stored inside the record cover along with additional artwork and/or a booklet containing song lyrics, artwork, and/or photographs of the band. Furthermore, many recorded albums are comprised of two or more phonographic records collectively forming the entirety of the album. Due to the varying amount of phonographic records and or booklets and artwork, phonographic record album covers generally vary in thickness.

For example, gatefold record album covers open up in a book-like manner, featuring a wider spine on the binding end of the phonographic record cover and thus increased depth. A majority of conventional phonographic record wall display apparatuses incorporate traditional frames used for photos and paintings with rigid frames and glass covers. These commercially-available displays offer an observer only the front view of a phonographic record or record cover, thus blocking the view of the left, right, top, and bottom view of the phonographic record cover. These phonographic record wall display frames present the phonographic record in a manner similar to a photograph and only provide a limited, two-dimensional view of the phonographic record.

This type of display can have a detrimental effect on an owner wishing to place such a collectible on the market for sale or to have it properly appraised by a dealer because the views are limited. In addition, such conventional frames are usually permanently sealed and do not allow owners to open them up for inspection. In extreme cases, handlers can risk damaging a valuable phonographic record if they use sharp tools and attempt to retrieve it from a conventional frame.

Furthermore, most of the existing phonographic record wall display apparatuses that are commercially available do not lend themselves to easily switching between displaying phonographic covers to displaying phonographic records. In addition, many of the phonographic record wall display apparatuses available today provide no method for easily-accessing the record without damaging the frame in the event they would like to install other records. Another object of the present invention is to provide ease-of-access to the phonographic record on display. Users can switch between displaying a phonographic record cover and a phonographic record with ease by removing the cover quickly.

Therefore, what is desired is a phonographic record display case that allows users to selectively display a phonographic record or a record album cover, while providing unobstructed visibility from two or more sides. Also, what is desired is a phonographic record display having a frame-free design and transparent tray display apparatus that allows for a full, profile view of a record's spine displaying critical information as well as left, right, top, and bottom views of the phonographic record cover, which are crucial to collectors and appraisers that need to see important identifiers.

SUMMARY OF THE INVENTION

The present invention is directed to a display case apparatus for selectively-displaying a planar item that contains a circular aperture or through hole, such as a phonographic record.

The present invention is also directed to a display case apparatus for selectively-displaying a completely planar item, without a circular aperture or through hole, such as a phonographic record cover, sleeve, or booklet.

The display apparatus assembly according to the present invention is generally comprised of the following components: a base member—also referred to as a 'backing wall member' having a 'circular recessed cavity' and a 'circular backing panel;' a 'reversible cylinder-shaped spindle adaptor member,' and a removable, 'transparent tray cover member.' The aforementioned base member is essentially formed as a circular recess. This recess is located in the center of the base member and has four openings for mounting the base member to a wall by means of screws 20 or various other attachment means. However, the present general inventive concept is not limited thereto. That is, in alternative embodiments, the backing wall member (i.e., a base member) may further be formed with aesthetic designs and/or colors to provide an enhanced or improved presentation of the phonograph record or phonograph record album cover stored therein.

An object of the invention is to provide support to an enclosure that can withstand the load of such an object on a wall. The inside of the apparatus has strong mating features within a 'circular recess.' This feature has a stepped, outer margin that can be coupled with a secondary outer margin coupling. The 'circular backing panel' couples with the circular cavity of the 'base member' by engaging the coupling member of the circular backing panel and allows a record or disk to be anchored flush inside the circular cavity and rest securely against the 'backing panel wall member.' This coupling feature provides backing support for the items on display inside the apparatus.

Another object of the invention is to provide a securement feature that is perpendicular the vertical axis of which an item is to be displayed. A reversible cylinder-shaped, 'spindle adaptor member' couples with the aforementioned circular cavity mating feature in the circular display panel member. The reversible, cylinder-shaped spindle adaptor can be coupled with the aforementioned circular cavity in two configurations and gives a user the choice of displaying a planar item with circular opening (such as a record) or a planar item having no opening (such as a record jacket). In the first configuration, the cylinder-shaped spindle adaptor couples with the spindle-shaped axial end facing away from the cavity. The spindle-shaped portion of the adaptor extends into the opening in a record. In the second configuration the cylinder-shaped spindle adaptor couples with the planar axial end and faces away from the cavity. In this opposite position, the adaptor is flat and can support the backside of a planar or thin book item having no hole.

Another object is to allow a user to selectively replace items inside the invention. The 'transparent tray cover member' comprises a planar panel with outer walls forming a tray, and coupling members protruding inward from the left and right outer walls. The invention also features a 'gib' on an internal surface of the coupling member wall that provides a temporary locking mechanism allowing a user to easily open and close the invention. The transparent tray cover coupling member is selectively affixed to the mating cutouts of the backing panel wall member by engaging the gibs and the cutouts of the backing panel wall member, thereby selectively enclosing the item on display in a transparent tray.

Another object of the invention is to anchor a record in a vertical position and flush with a wall or vertical surface. This anchoring is achieved by a circular backing panel member having the following: a planar surface and circular cavity in the center with coupler notches on the interior wall of the cavity; an outer annular wall fixedly connected to said circular backing panel member planar surface periphery, two posts molded at the circular backing panel member (each coupler members at the axial end being configured to interact with the mating feature of the backing panel wall member circular cavity); a cylinder-shaped, reversible adaptor member. This adaptor member is affixed to a spindle that feeds into a record aperture and allows the record to be held in the vertical position without falling over.

Another object of the invention is to allow items such as records to be positioned directly in the center of the invention. Said spindle being comprised of an elongated cylinder, with a spindle-shape on one axial end and a planar surface on the opposite axial end along with mating channels on the outer walls. Said mating channels on cylinder adaptor member engage the circular backing panel member by means of mating channels on the cylinder adaptor member and the coupling notches in the cavity of the circular display panel. When a record is held inside, the spindle shaped axial end of the cylinder adaptor positioned away from the cavity and extends into the opening of the planar item and engages the inner wall of the planar item opening and engages the planar item to the cylinder-shaped adaptor. This engagement allows an item to be positioned directly in the center of the invention at all times and provides a professional aesthetic for the item being viewed.

Another object of the invention is to provide a means to view an artifact while at the same time protect it from the environment (moisture, humidity, dirt and soot etc.). A transparent, tray cove is comprised of the following internal features: an outer annular wall molded to and surrounding the planar surface of the cover; the outer annular wall and planar surface define the periphery of the display window; a front edge; and a rear edge (that defines an opening for an article to pass through).

Another object of the invention is to provide a means to allow a user to temporarily lock records and discs inside the invention. The apparatus includes 'deformable mating jibs' that are molded to the inner walls of both of the aforementioned cover member and backing panel member. When engaged, these elements temporarily prevent the invention from inadvertently being opened yet still allow a user to pull the transparent tray cover member from the backing panel wall member and retrieve and replace the item inside.

Certain of the foregoing and related aspects are readily attained according to the present general inventive concept by providing a display case apparatus for selectively displaying a phonograph record or album cover including a base member having a recess member formed therein, a display panel member detachably coupled within the recess member of the base member, a spindle member detachably coupled to the display panel member, the spindle member having a first side having a protrusion configured to fit within a hole of the phonograph record and a second opposing side having a planar surface configured to receive the album, and a cover member detachably coupled to the base member to protect items disposed on the spindle member.

The recess member may be formed on a planar portion of the base member such that one or more sidewalls connect the planar portion to a bottom surface of the recess member.

The base member may include one or more cutout portions around a perimeter thereof.

The cover member may include one or more attachment members configured to be detachably coupled to the one or more cutout portions on the base member.

The cover member may be formed of a transparent material to provide complete visibility to the phonograph record or album disposed on the spindle member from all angle, from the top side, the bottom side, the left side, the right side, and the front side.

The cover member may be formed of a transparent material to provide complete visibility to the phonograph record or album disposed on the spindle member from all angles from the top side, the bottom side, the left side, the right side, and the front side.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE EXEMPLARY EMBODIMENTS

Figure 1:
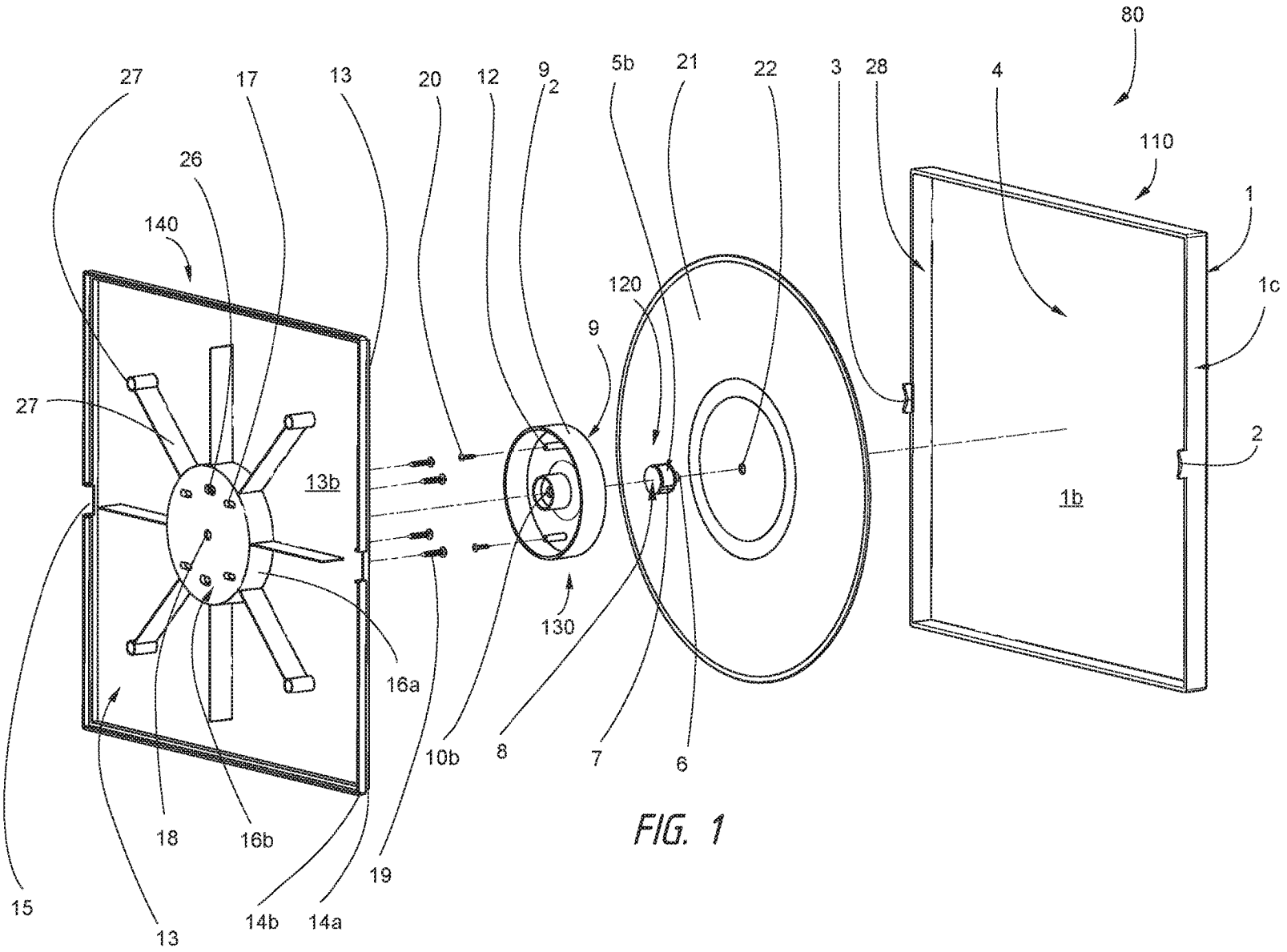
FIG. 1 is an exploded, rear perspective view of a display case apparatus according to an example embodiment of the present general inventive concept, with a spindle adaptor configured/aligned/positioned to mount a flat item with circular opening, such as a phonographic record.

The present inventive concept will now be described more fully with reference to the accompanying drawings, in which exemplary embodiments of the present general inventive concept are illustrated. The present general inventive concept may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals refer to like elements throughout.

The following description is intended to be read in correlation with the accompanying drawings, which are to be considered part of the written description. The following detailed descriptions are to illustrate the preferred embodiments of the invention and are not intended to limit the scope of the present invention. Descriptive terms such as "top", "bottom", "left", "right", and "front", "rear", "inner", "outer", "above", "below, "up", "down", "forward", "backward", "upward" and "downward" are in reference to the orientation as shown in the drawings. These terms are descriptive of the drawings, and do not require the apparatus be operated in that particular orientation. Terms such as "engaged", "attached", "coupled", "interlock", "connect", "join" "retain" and derivatives thereof refer to the relationship wherein members are secured or attached to one another through intervening structures, as well as both rigid or moveable attachments or relationships.

The present general inventive concept provides a display case apparatus which may be attached to a wall or other surface that allows a user to selectively display a planar item having a through hole disposed along a central axis thereof, such as a phonographic record, or a completely planar item having no through hole disposed therein, such as a phonographic record cover, sleeve, or booklet. The display case apparatus is designed and/or configured to protect the phonographic record, cover, or the like from physical damage while simultaneously allowing a user to have complete visibility to the desired item. For example, when a record cover having a front side, a back side, a top side, a bottom side, a left side, and a right side, is disposed within the display case apparatus according to the present general inventive concept, the user may clearly see the front, top, left, right, and bottom sides of the record cover when the back side is facing the wall or other surface.

However, the present general inventive concept is not limited thereto. That is, in alternative embodiments, the display case apparatus may be formed in various shapes and sizes to receive various items having varying shapes and sizes.

In further embodiments, the display case apparatus may be designed and/or configured to protect the phonographic record, cover, or the like from ultraviolet light, moisture, humidity, oils, air, or the like, while simultaneously allowing a user to have complete visibility to the desired item.

Figure 2:
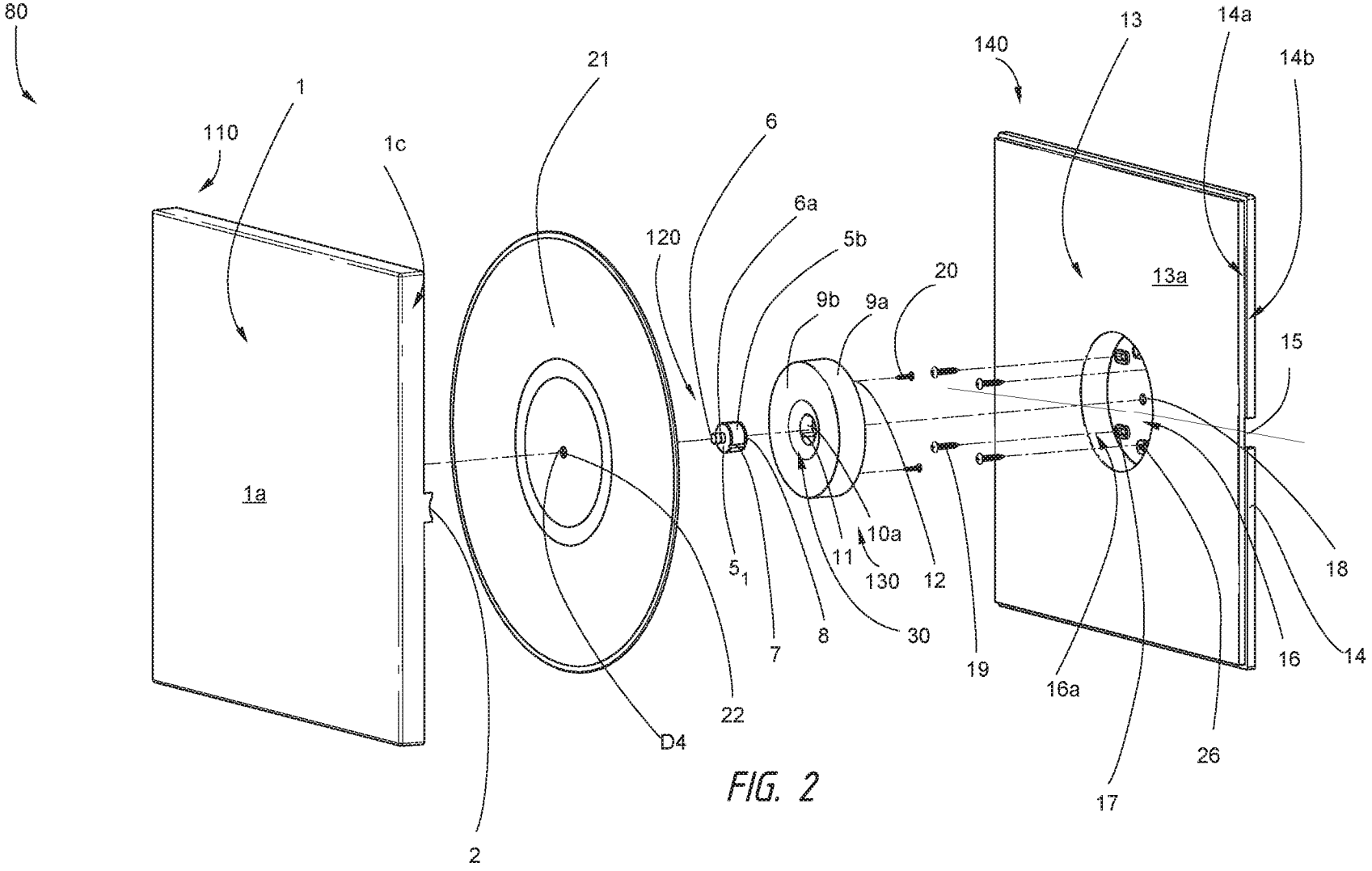
FIG. 2 is an exploded, front perspective view of the display case apparatus illustrated in FIG. 1.
Figure 3:
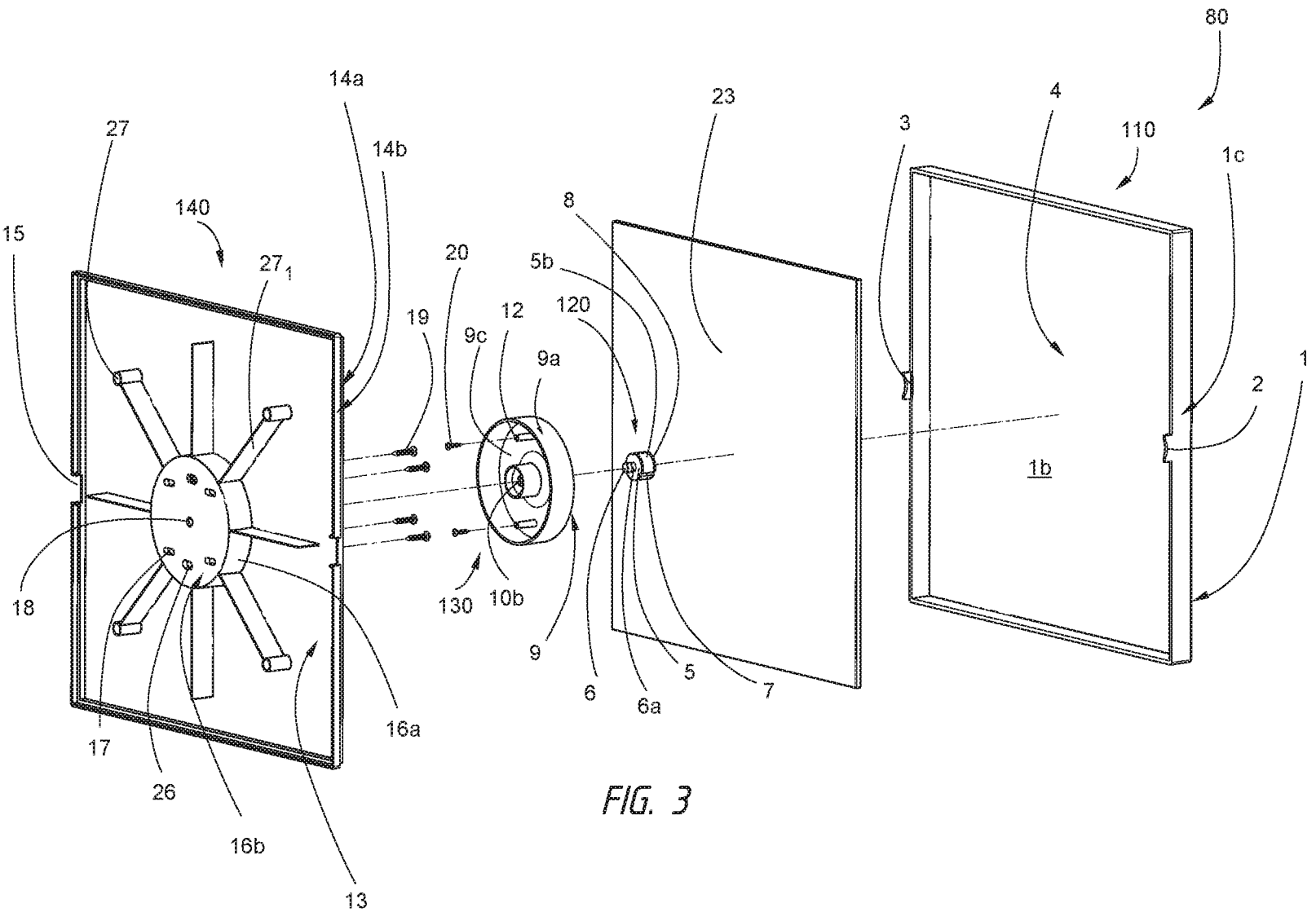
FIG. 3 is an exploded, rear perspective view the display case apparatus with the spindle adaptor configured/aligned/positioned to mount a flat item, such as a phonographic record sleeve or booklet.
Figure 4:
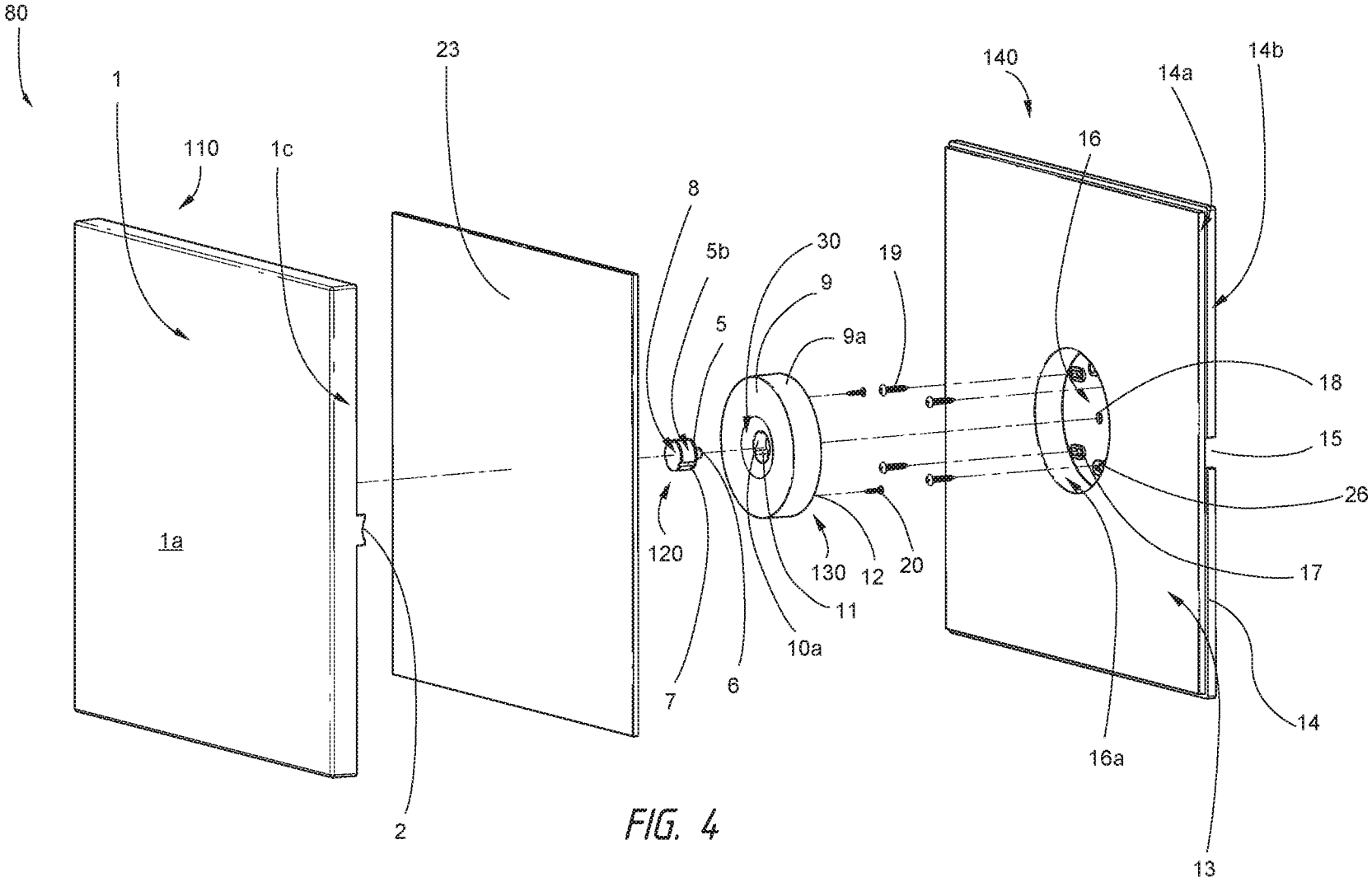
FIG. 4 is an exploded, front perspective view of the display case apparatus illustrated in FIG. 3.
Figure 5:
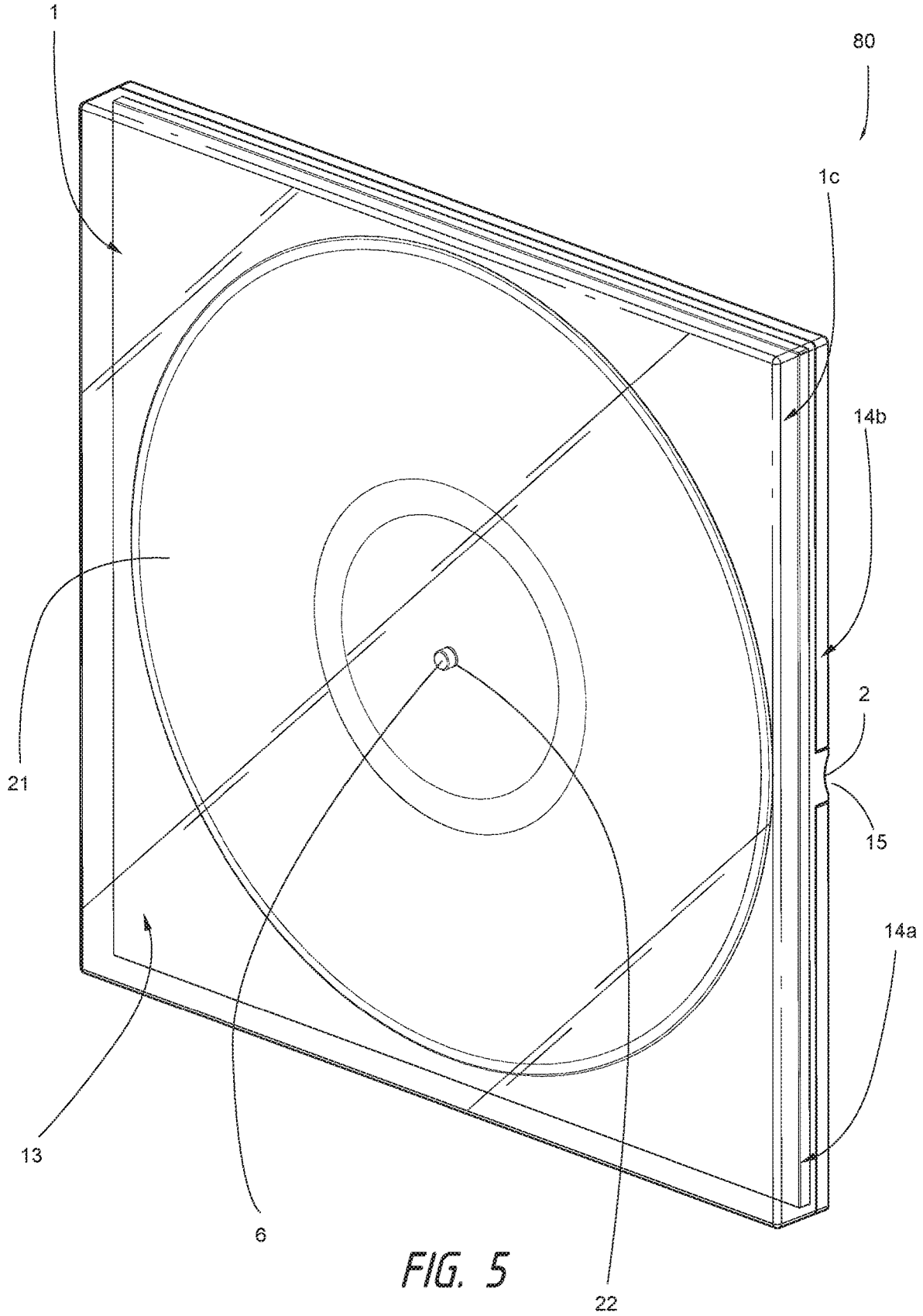
FIG. 5 is a front perspective view of the display case apparatus illustrated in FIG. 2 in an assembled state.
Figure 6:
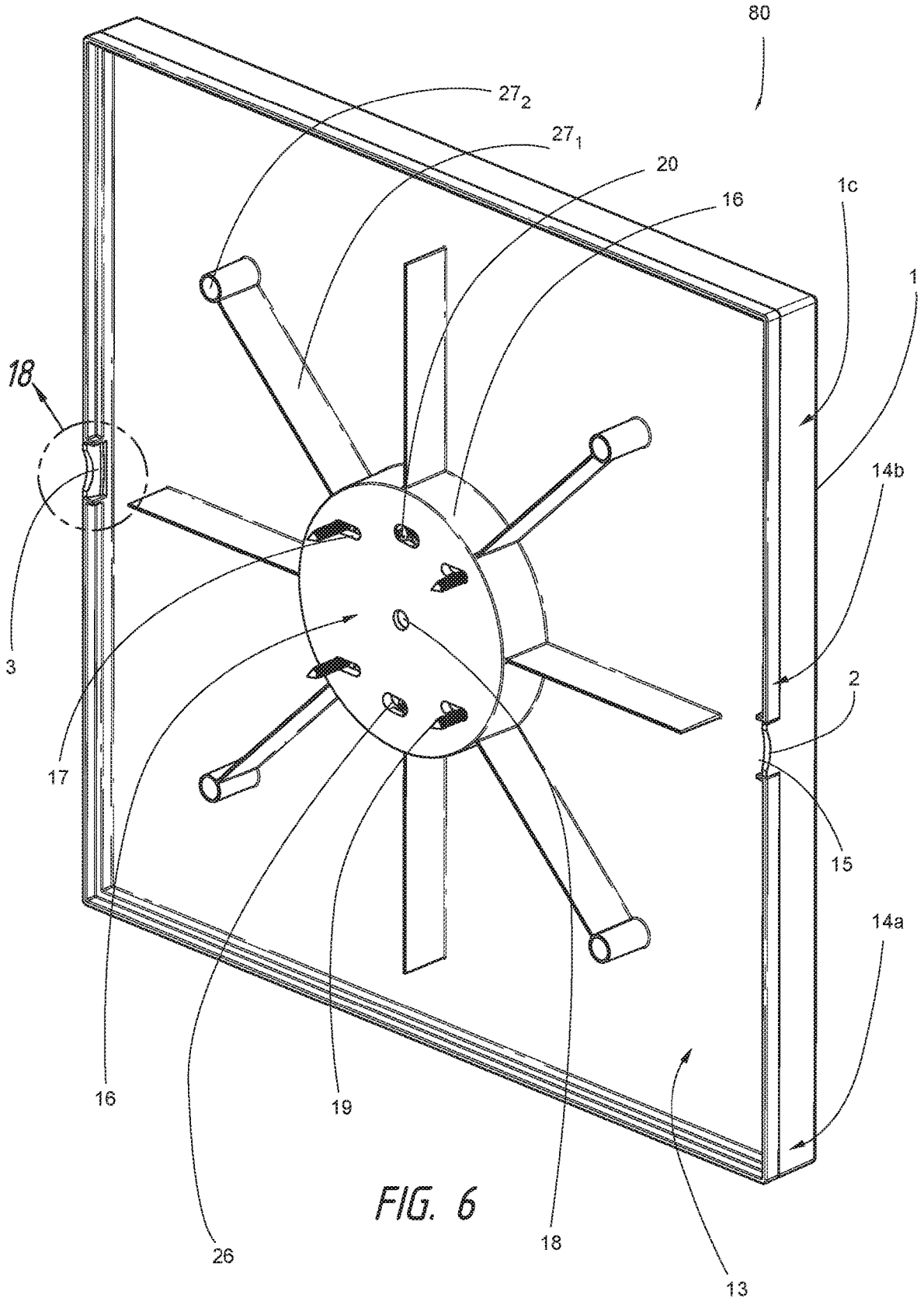
FIG. 6 is a rear perspective view of the display assembly apparatus illustrated in FIG. 5.
Figure 8:
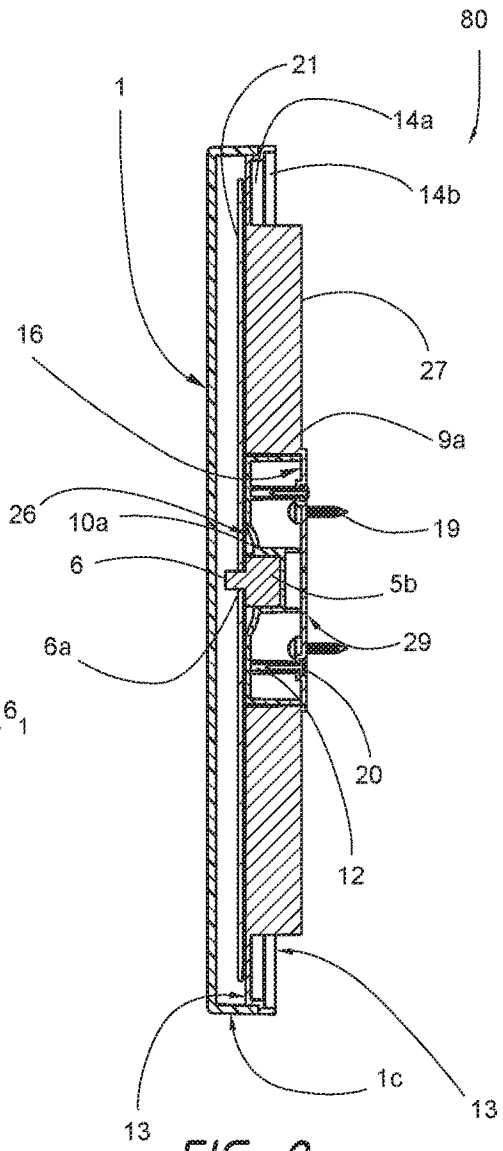
FIG. 8 is a cross-sectional view along lines 8-8 of FIG. 7.
Figure 7:
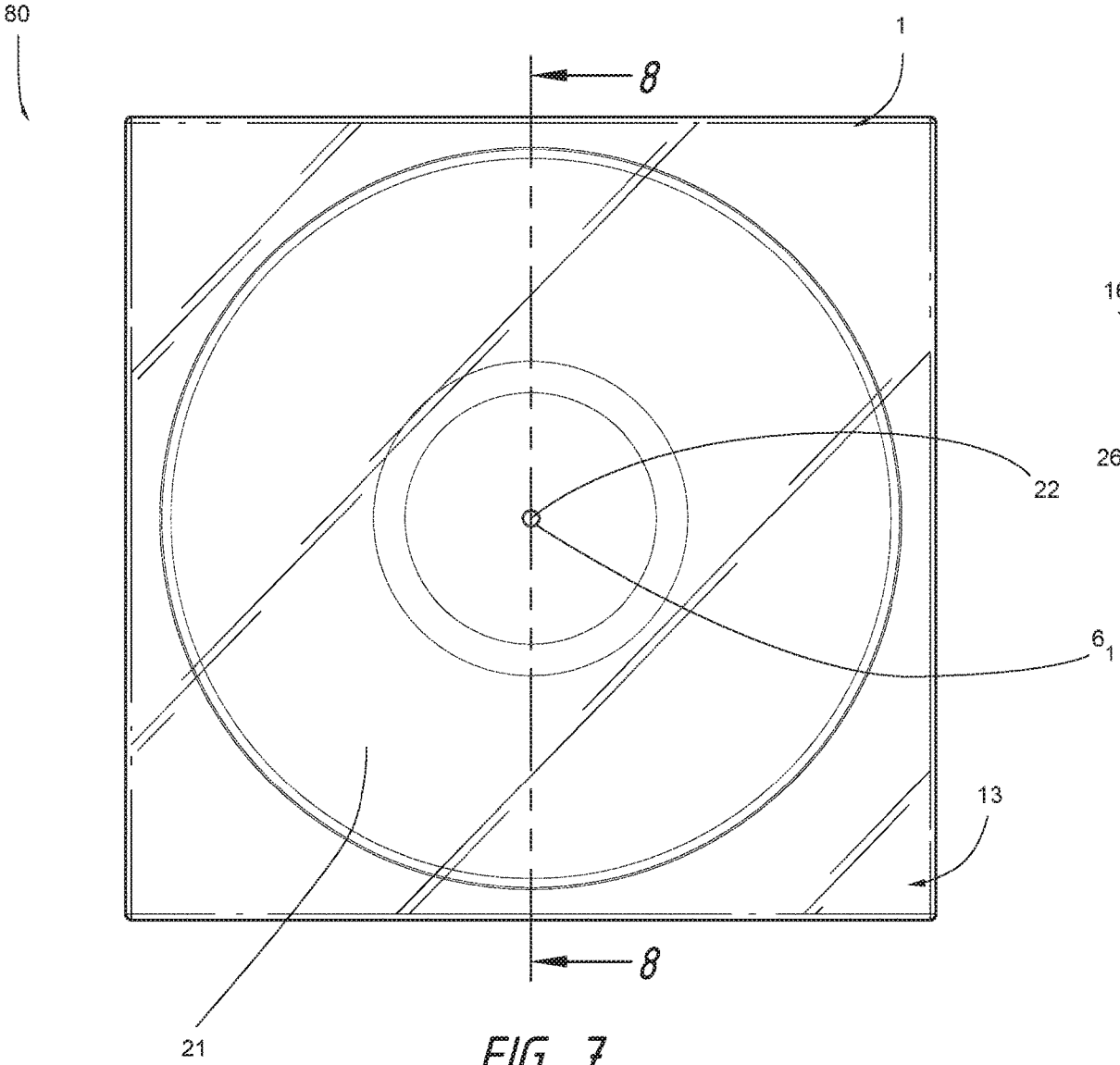
FIG. 7 is a top plan view of the display case apparatus illustrated in FIG. 5, displaying a flat item with a circular opening such as a disk/record.
Figure 10:
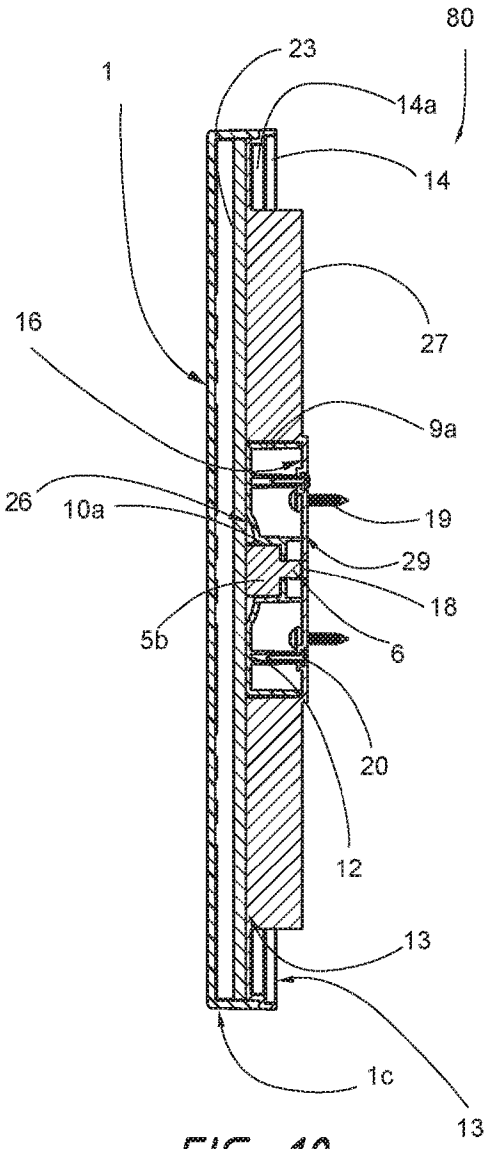
FIG. 10 is a cross-sectional view along lines 10-10 of FIG. 9.
Figure 9:
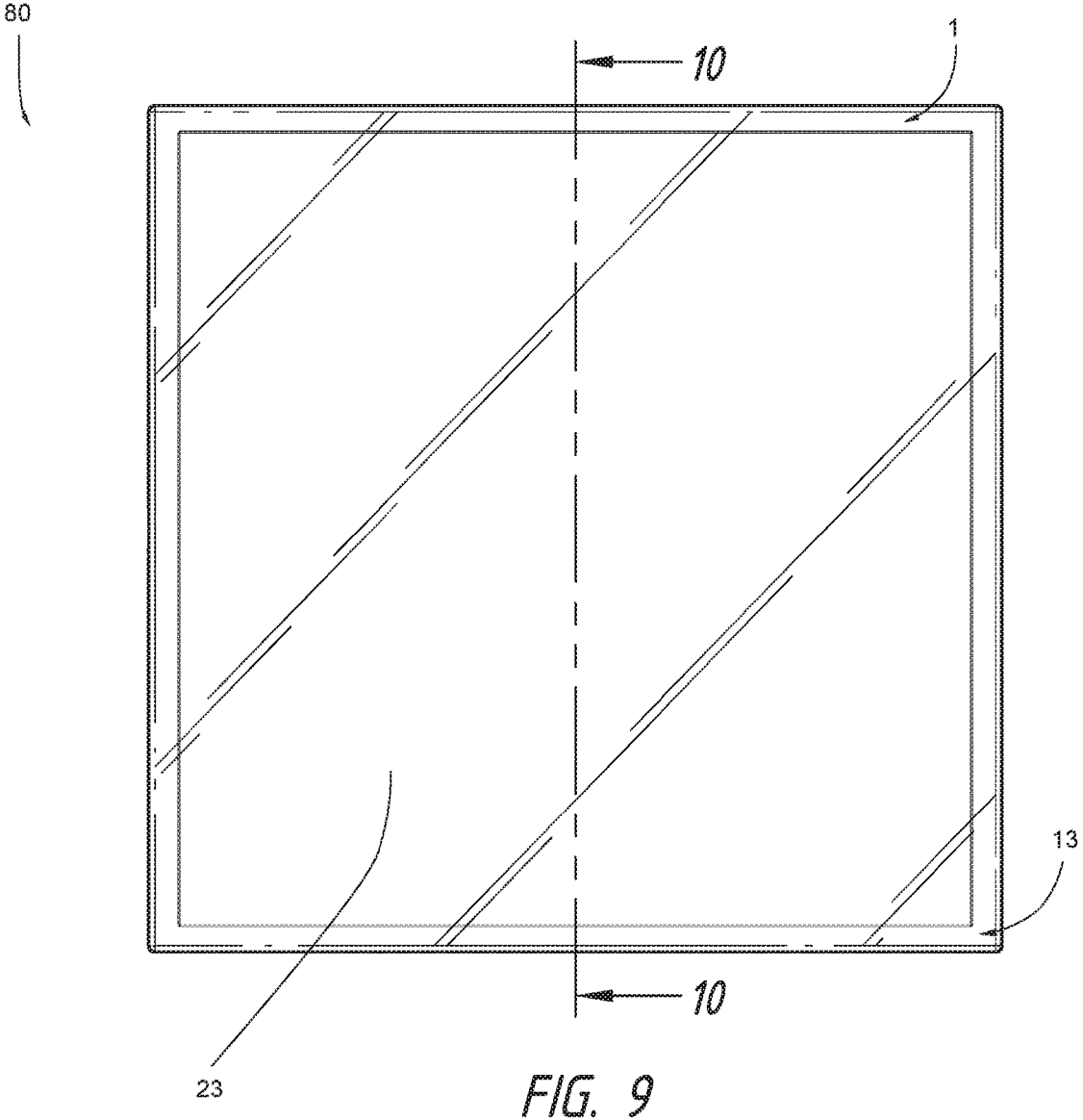
FIG. 9 is a top plan view of the display case apparatus illustrated in FIG. 4 in an assembled state displaying a flat item, such as a phonographic record sleeve or booklet.
Figure 11:
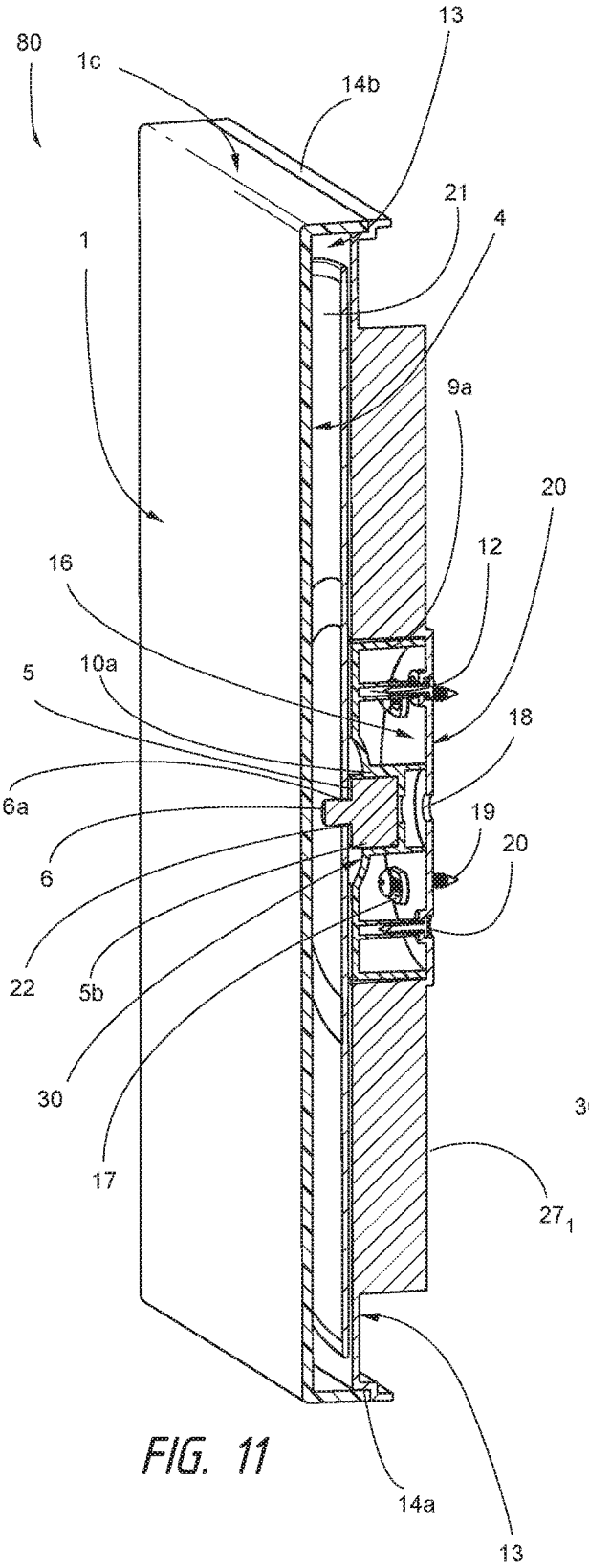
FIG. 11 is a rear perspective view of the display case apparatus cut away along line 8-8 of FIG. 7.
Figure 12:
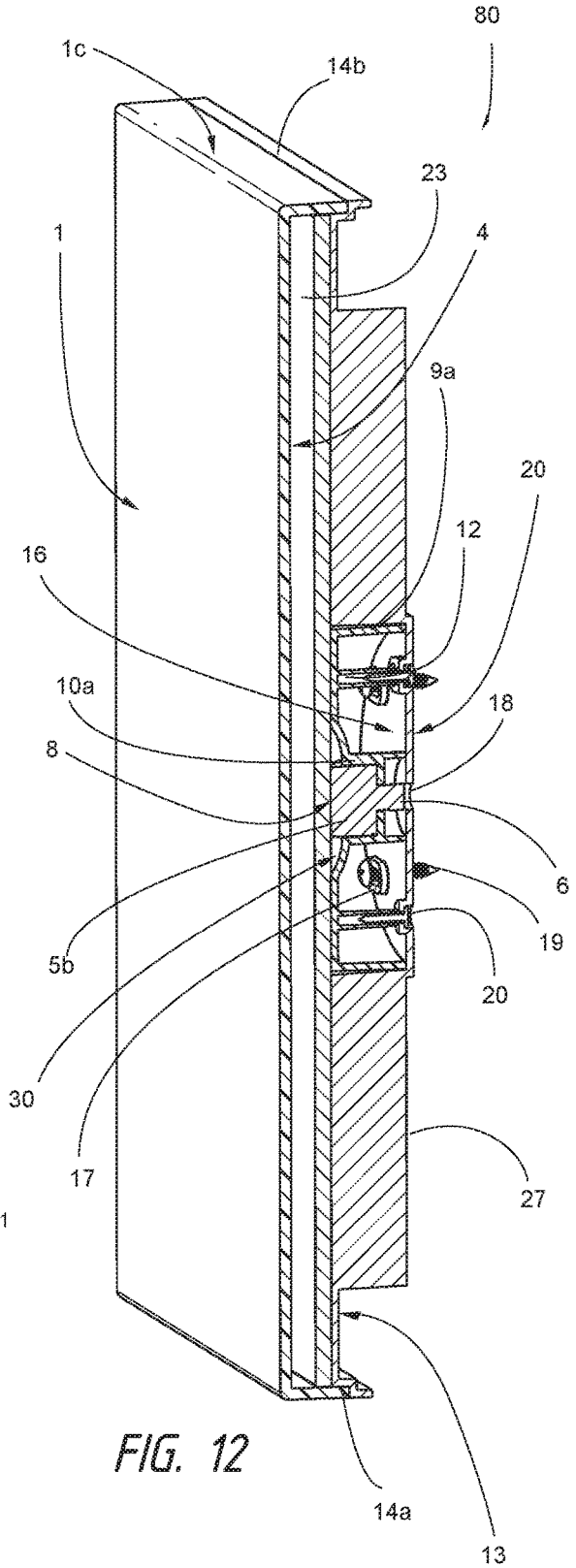
FIG. 12 is a rear perspective view of the display case apparatus cut away along line 10-10 of FIG. 9.
Figure 13:
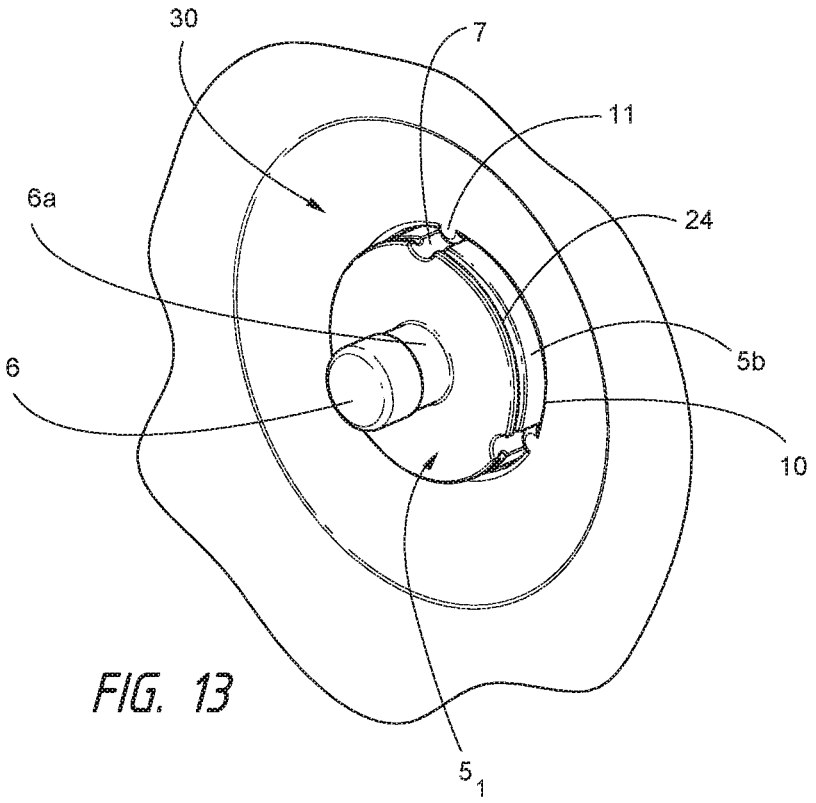
FIG. 13 is a partial view of the display panel with the adaptor mounted therein in the flat item with a circular opening displaying position.
Figure 14:
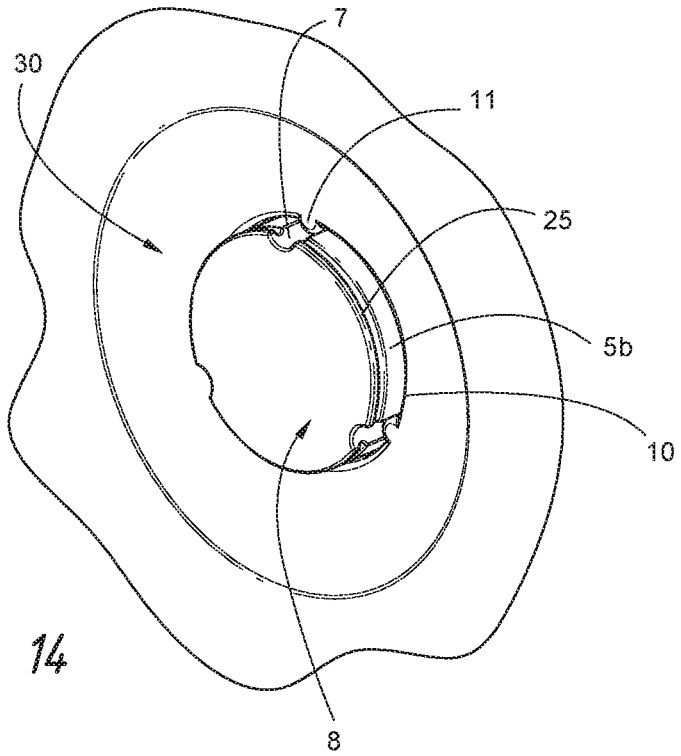
FIG. 14 is a fragmentary view of the display panel with the adaptor mounted therein in the flat item displaying position.

FIG. 1 is an exploded, rear perspective view of a display case apparatus 80 according to an example embodiment of the present general inventive concept, with a reversible spindle adaptor/member 120 configured/aligned/positioned to mount a flat item with circular opening, such as a phonographic record 21. FIG. 2 is an exploded, front perspective view of the display case apparatus 80 illustrated in FIG. 1, FIG. 3 is an exploded, rear perspective view the display case apparatus 80 with the spindle adaptor 120 configured/aligned/positioned to mount a flat item, such as a phonographic record cover 23, sleeve, or booklet, and FIG. 4 is an exploded, front perspective view of the display case apparatus 80 illustrated in FIG. 3. FIG. 5 is a front perspective view of the display case apparatus 80 illustrated in FIG. 2, in an assembled state and FIG. 6 is a rear perspective view of the display assembly apparatus 80 illustrated in FIG. 5.

Referring to FIGS. 1 and 2, the display case apparatus, designated generally as 80, is illustrated. In the present embodiment, the display case apparatus 80 includes a cover member 110, a spindle member 120, a display panel member 130, and a base member 140.

The cover member 110 may be formed in a substantially square-shaped planar panel 1 having a first side 1*a* (i.e., front side) and opposing second side 1*b* (i.e., back side) and sidewalls 1*c* extending from the planar panel 1 so as to form a cavity 4 therein. That is, the sidewalls 1*c* extend away from the planar panel 1 to form a tray. The opposing sidewalls 1*c* may be formed to be parallel to each other, however the present general inventive concept is not limited thereto.

In the present embodiment, the cover member 110 may be manufactured as a one-piece molded part of a substantially rigid transparent material, such as plastic. However, the present general inventive concept is not limited thereto. That is, in alternative embodiments, the cover member 110 may be formed of various materials having various levels of transparency, colors, and/or tints.

In the present embodiment, the cover member 110 further includes one or more attachment members 2 and 3 configured to detachably couple to the base member 140 to protect items disposed within the display case apparatus 80 from damage.

The base member 140 may be formed to correspond with a shape and size of the cover member 110 as a substantially square-shaped planar panel 13 having a first side 13*a* (i.e., front side) and opposing second side 13*b* (i.e., back side). However, the present general inventive concept is not limited thereto.

In the present embodiment, the base member 140 further includes a recess member 16 disposed at a center of the base member 140. The recess member 16 includes a recess sidewall 16*a* extending from the first side 13*a* toward the second side 13*b* and a recess backwall 16*b* having a plurality of cutouts 17 configured to be attached to a wall or other surface. In exemplary embodiments, the recess member 16 may be formed in a cylindrical shape, however, the present general inventive concept is not limited thereto. That is, in alternative embodiments, the recess member 16 may be formed in various shapes and sizes, including but limited to a polygonal shape, such as a cube, triangle, pentagon, hexagon, octagon, or the like.

In the present embodiment, the base member 140 further includes a stepped outer sidewall 14 formed along the perimeter of the planar panel 13. The stepped outer sidewall 14 includes two sidewalls coupled together 14*a*, 14*b* to form a step along the outer edge of the base member 140.

In the present embodiment, the base member 140 further includes one or more cutout portions 15 formed on the stepped outer sidewall 14 and configured to be detachably coupled to the one or more attachment members 2 and 3 of the cover member 110.

In the present embodiment, the base member 140 includes a first cutout portion 15*a* on a first side of the base member 140 and a second cutout portion 15*b* on an opposing second side of the base member 140. The first and second cutout portions 15*a* and 15*b* are disposed along a center line of the planar panel 13, at an equal distance from top and bottom sides of the planar panel 13. However, the present general inventive concept is not limited thereto.

In the present embodiment, the recess backwall 16*b* includes a plurality of through holes configured to receive attachment members 19, such as screws, nails, bolts, or the like, in order to couple the base member 140 to a wall or other surface and a plurality of slot members 26 to detachably couple the display panel member 130 to the base member 140. The base member 140 is designed and/or configured to protect the back side of the record cover, for example, while disposed within the display case apparatus 80.

In the present embodiment, the base member 140 may be manufactured as a one-piece molded part of a substantially rigid opaque material, such as plastic. However, the present general inventive concept is not limited thereto. That is, in alternative embodiments, the base member 140 may be formed of various materials having various levels of rigidity, transparency, colors, and/or tints. In further embodiments, the base member 140 may be formed of various materials, including but not limited to hard or soft plastics, polystyrene, polyurethane, glass, acrylic, wood, metal, paper, or the like.

The second side 13*b* may further include structural support members 27 to provide rigidity to the base member 140.

Referring to FIGS. 1 through 4, the display panel member 130 may be formed in a substantially circular-shaped planar panel 9 having an outer annular sidewall 9*a*. The circular-shaped planar panel 9 has a first side 9*b* (i.e., front surface) and opposing second side 9*c* (i.e., back surface). The first side 9*b* includes a concave dish portion 30 and a cavity 10 formed therein. The dish portion 30 may be formed in a substantially circular shape and the cavity 10 may be formed in a substantially cylindrical shape. However, the present general inventive concept is not limited thereto.

In the present embodiment, the cavity 10 of the display panel member 130 includes an inner annular wall 10*a* and a backwall 10*b* having a circular recess at a center portion of the backwall. The inner annular wall 11 of the cavity 10 further includes a plurality of semi-cylindrical protrusions 11 configured to assist in the alignment, coupling, and mating of the spindle member 120 to the display panel member 130. The outer annular wall 5 of the spindle member 120 may include a plurality of incurvate semi-cylindrical recesses 7 which are configured to engage/couple to the bumps of the spindle member 120.

The display panel member 130 is configured to be detachably coupled within the recess member 16 of the base member 140 using a plurality of attachment members 20. However, the present general inventive concept is not limited thereto.

Figure 15:
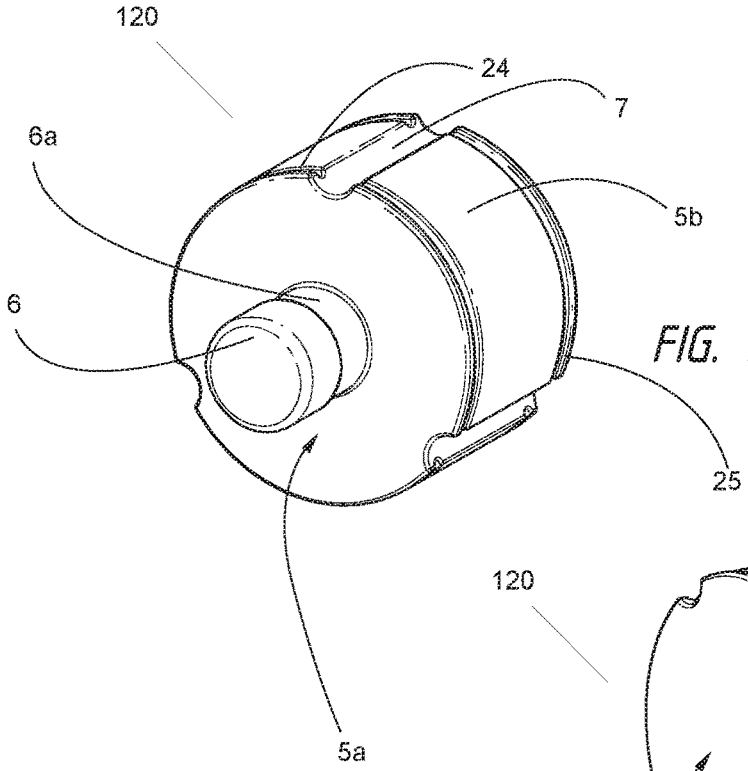
FIG. 15 is a front perspective view of the spindle adapter according to an example embodiment of the present general inventive concept showing a first end configured to receive a flat item with circular opening.
Figure 16:
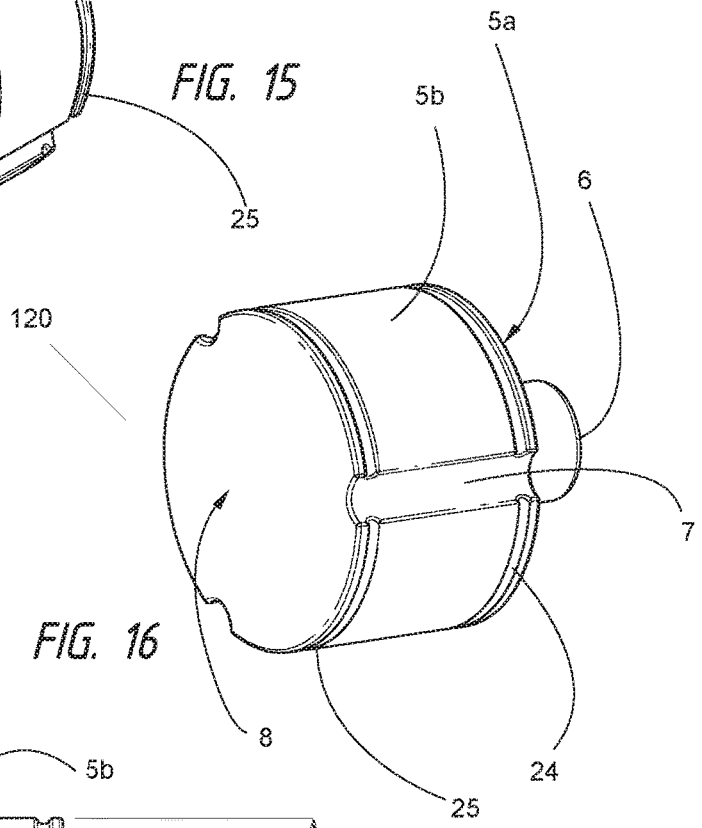
FIG. 16 is a rear perspective view of the spindle adapter illustrated in FIG. 15 showing a second end configured to receive a flat item without a circular opening.

FIG. 15 is a front perspective view of the spindle member 120 according to an example embodiment of the present general inventive concept showing a first end 5*a* configured to receive a flat item with circular opening. FIG. 16 is a rear perspective view of the spindle member 120 illustrated in FIG. 15 showing a second end 8 configured to receive a flat item without a circular opening or through hole, and FIG. 17 is a side view the spindle member 120 illustrated in FIG. 15.

Figure 17:
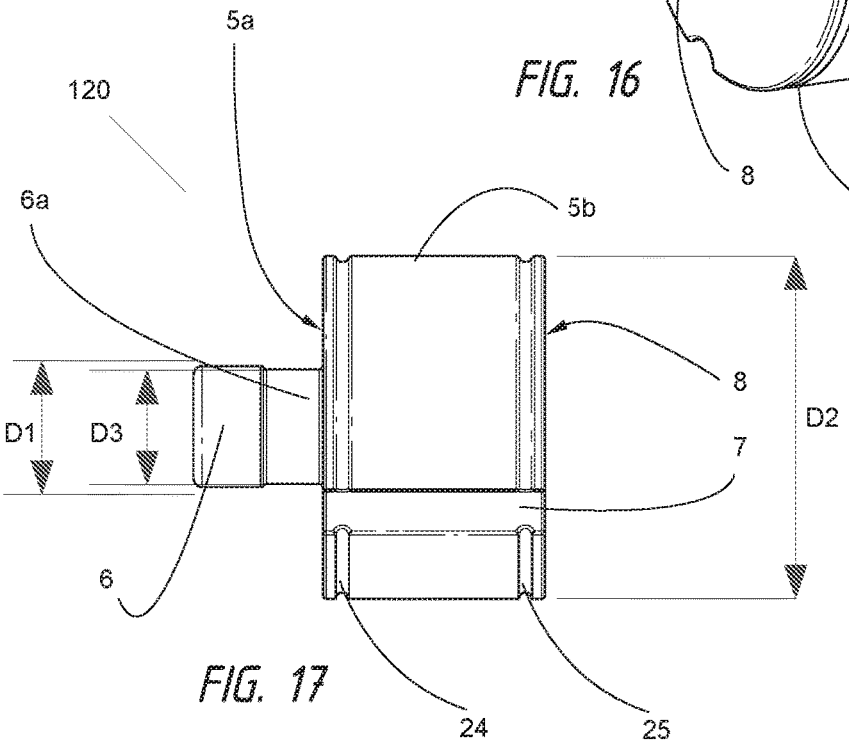
FIG. 17 is a side view the spindle adaptor illustrated in FIG. 15.
Figure 18:
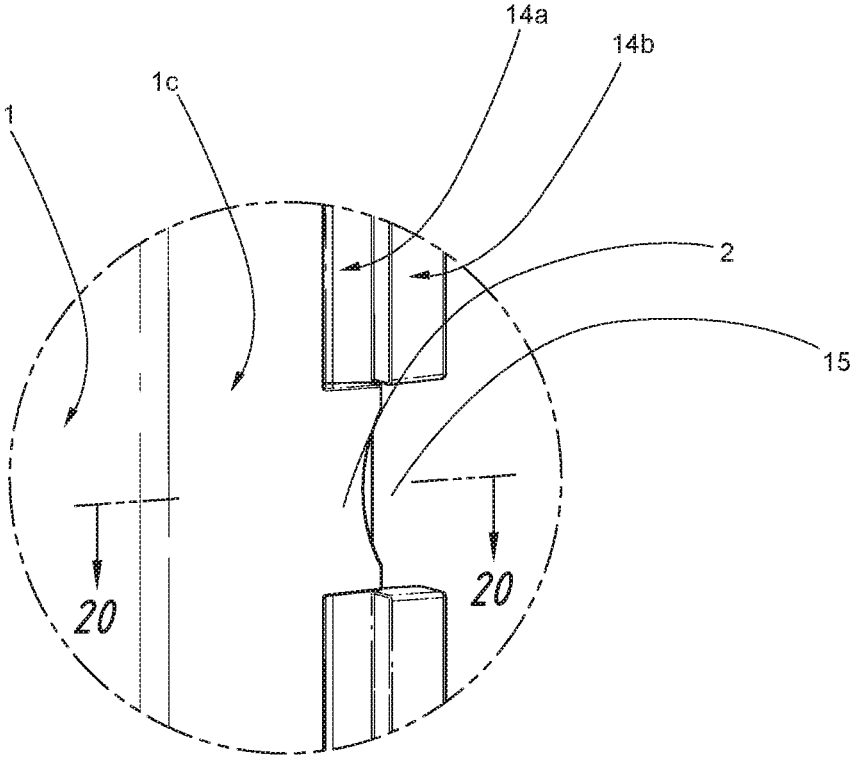
FIG. 18 is a fragmentary front perspective view of the transparent cover member engaging the display panel member recess.
Figure 19:
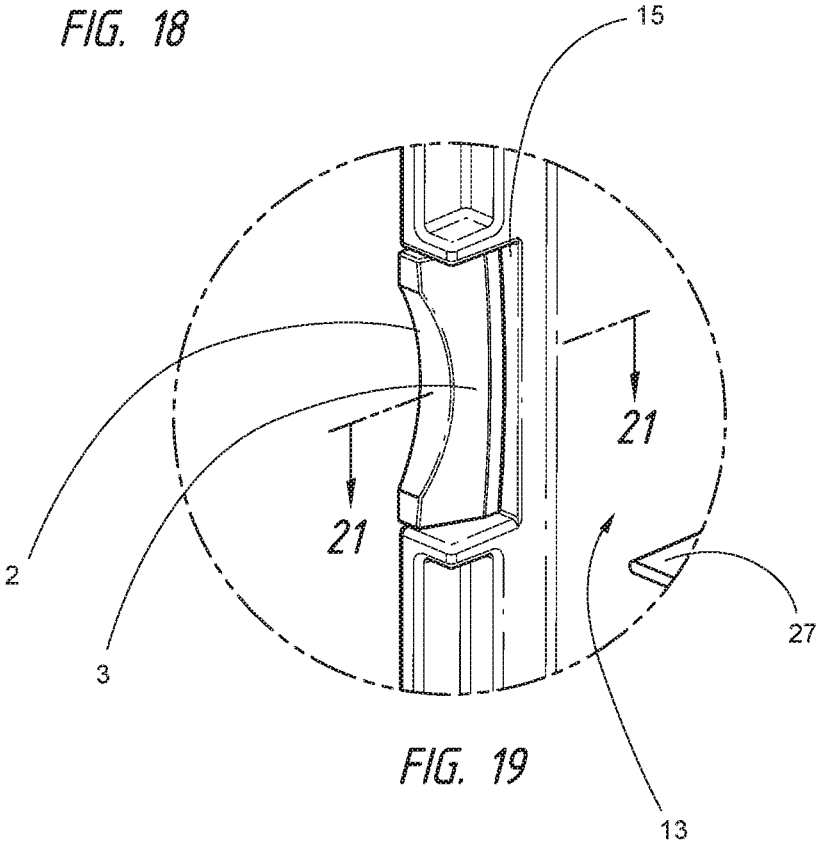
FIG. 19 is a fragmentary rear perspective view of the transparent cover member engaged with the display panel member recess.
Figure 20:
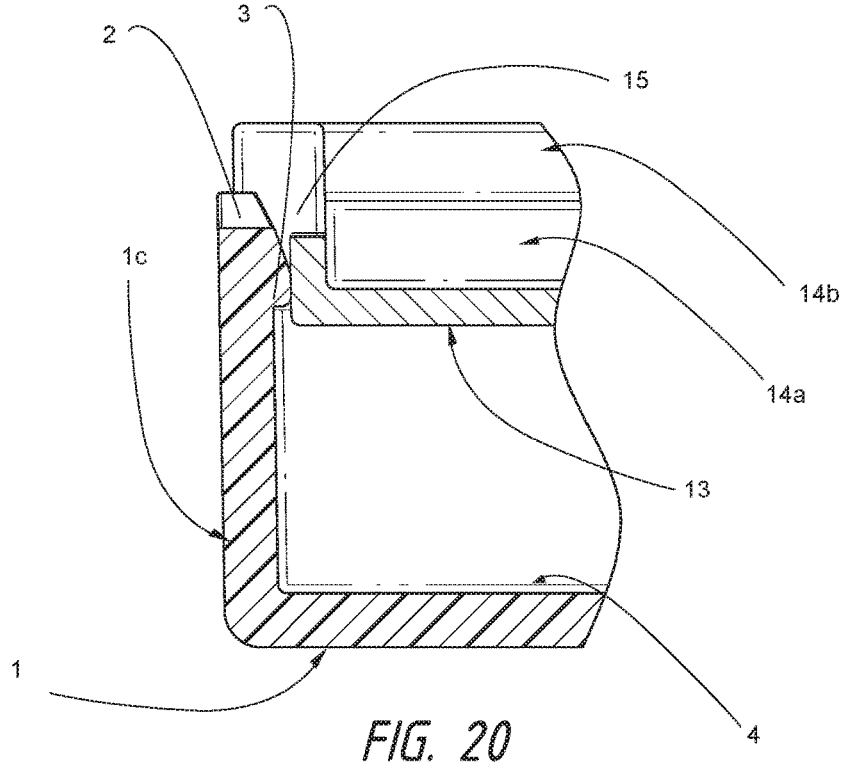
FIG. 20 is a cross sectional view along the line 20-20 of FIG. 18.
Figure 21:
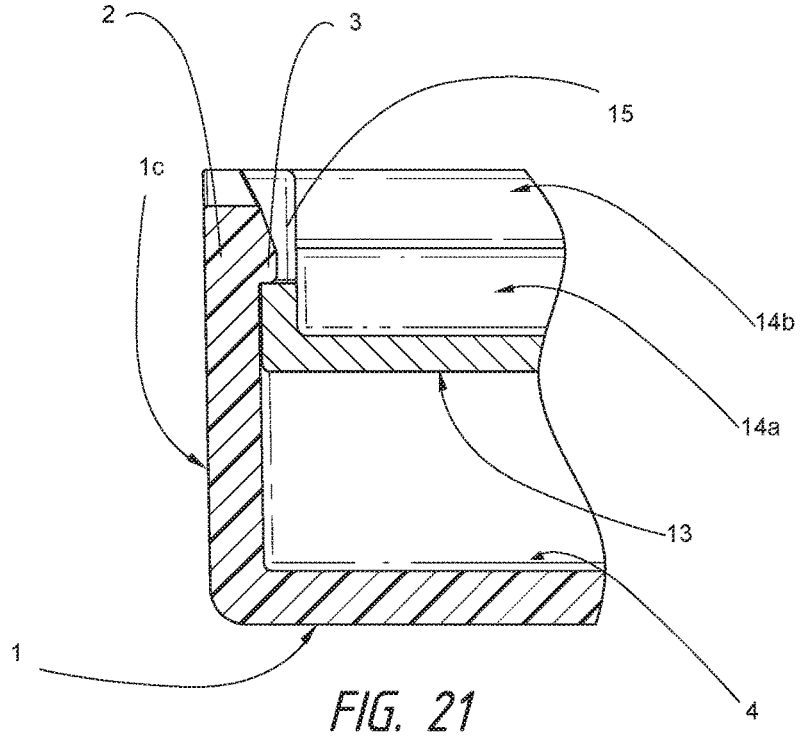
FIG. 21 is a cross sectional view along the line 21-21 of FIG. 19.

Referring to FIGS. 15-17, the spindle member 120 may be formed in a substantially cylindrical shape having a first side 5*a* having a protrusion or post 6 extending therefrom configured to fit within a hole 22 of the phonograph record 21 and a second opposing side 8 having a planar surface configured to receive and completely support a completely planar item 23. However, the present general inventive concept is not limited thereto. That is, in alternative embodiments, the spindle member 120 may be formed in various shapes having a first completely planar side at one axial end and a second side at the opposing axial end having a protrusion extending therefrom.

In the present embodiment, the spindle member 120 is detachably coupled to the display panel member 130. The diameter D1 of the protrusion or post 6 may be smaller than a diameter D2 of the spindle member 120. The protrusion or post 6 may further include a channel 6*a* formed around the protrusion or post 6 having a diameter D3 smaller than the diameter D1 of the protrusion or post 6. In the present embodiment, the diameter D1 of the protrusion or post 6 is substantially equal to or smaller than a diameter D4 of a through hole 22 within a conventional phonographic record 21. A depth W1 of the channel 6*a* may be slightly larger than a depth W2 of the conventional phonographic record 21.

In the present embodiment, the spindle member 120 may further include an outer annular sidewall surface 5*b* having a plurality of first incurvate mating channels 7 extending longitudinally from the first side 5*a* to the second side 8 and a plurality of second incurvate mating channels 24 and 25 extending around a perimeter of the annular sidewall surface 5*b* and substantially parallel to each other. In addition, the plurality of second incurvate mating channels 24 and 25 run parallel to the edges of the axial ends 5*a*, 8 of the spindle member 120.

In the present embodiment, the spindle member 120 may be manufactured as a one-piece molded part of a substantially rigid opaque material, such as plastic. However, the present general inventive concept is not limited thereto. That is, in alternative embodiments, the spindle member 120 may be formed of various materials having various levels of rigidity, transparency, colors, and/or tints. In further embodiments, the spindle member 120 may be formed of various materials, including but not limited to hard or soft plastics, polystyrene, polyurethane, glass, acrylic, wood, metal, paper, or the like.

Figure 22A:
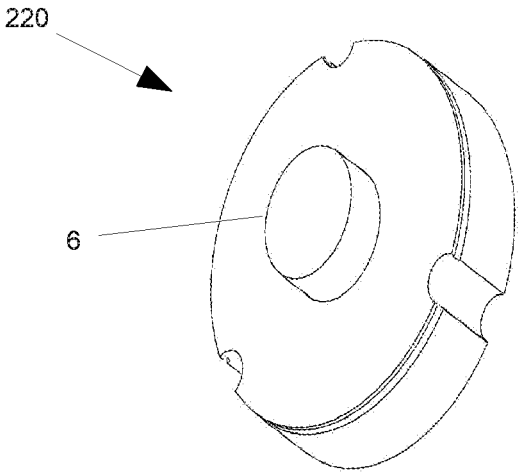
FIGS. 22A through 22C illustrate a spindle adapter according to another example embodiment of the present inventive concept, in a first protrusion extended state.
Figure 22B:
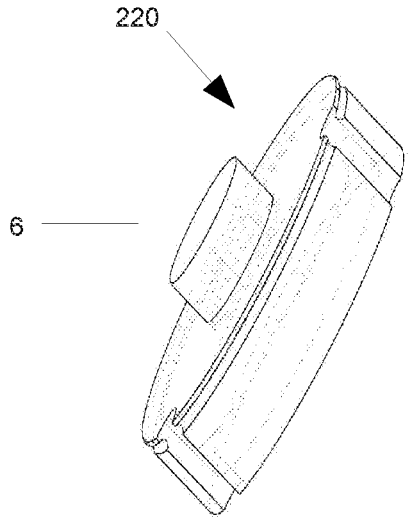
Figure 22C:
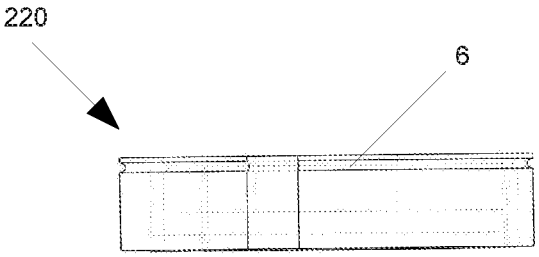
Figure 23A:
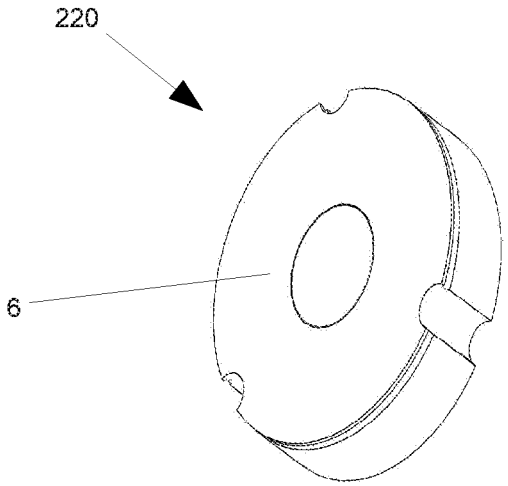
FIGS. 23A through 23C illustrate the spindle adapter illustrated in FIG. 22A, in a second protrusion retracted state.
Figure 23B:
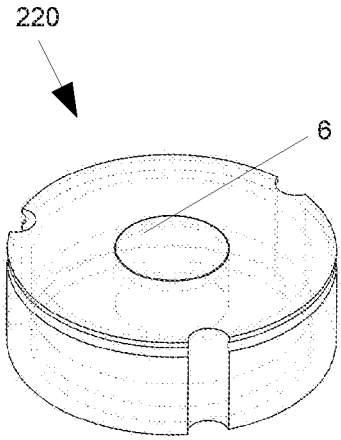
Figure 23C:
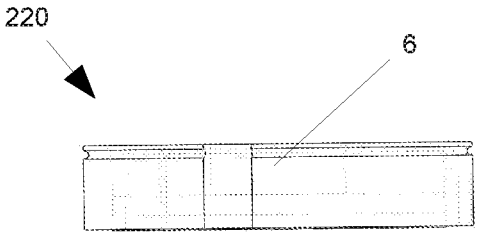

FIGS. 22A through 22C illustrate a spindle adapter 220 according to another example embodiment of the present inventive concept, in a first protrusion extended state and FIGS. 23A through 23C illustrate the spindle adapter illustrated in FIG. 22A, in a second protrusion retracted state.

In alternative embodiments, the spindle member 220 (i.e., retractable spindle member) may be configured to expose the protrusion 6 in a first state so as to fit within a hole of a phonograph record and retract the protrusion 6 in a second state so as to provide a planar surface to receive an album cover.

In the present exemplary embodiment, the display case apparatus 80 is configured to allow a user to selectively display a planar item that has a circular aperture or through hole, such as a phonographic record or a completely planar item, without a circular aperture or through hole, such as a phonographic record cover, sleeve, or booklet by rotating an orientation of the spindle member 120.

The display case apparatus 80 includes a base member 140 having a recess member 16 formed therein, a display panel member 130 detachably coupled within the recess member 16 of the base member 140, a spindle member 220 detachably coupled to the display panel member 130, the spindle member 220 having a first side 5*a* having a protrusion 6 configured to fit within a hole 22 of the phonograph record 21 and a second opposing side 8 having a planar surface configured to receive the a completely planar record cover or album 23, and a cover member 110 detachably coupled to the base member 140 to protect items disposed on the spindle member 220 from damage.

According to an exemplary embodiment, the display case apparatus 80 may be used as follows.

Referring to FIG. 2, when the user desires to display a phonographic record 21, the base member 140 is first attached to a wall or other surface by inserting attachment members 19, such as screws or nails, into the plurality of cutouts 17 of the recess backwall 16*b*. Next, the base member 140 is shifted so as to lock the attachment members 19 within the plurality of cutouts 17 to thereby secure the base member 140 to the wall or other surface as desired.

Next, the display panel member 130 is then inserted within the recess member 16 and aligned using the plurality of protrusions and secured in order to affix the display panel member 130 to the base member 140, while hiding the attachment member 19 and the plurality of cutouts 17.

Next, the spindle member 120 is inserted into the cavity 10 of the display panel member 130 such that the first side 5 having the protrusion or post 6 faces away from the base member 140 (i.e., first orientation state) and the second opposing side 8 having the planar surface faces toward the base member 140.

Next, the phonographic record 21 is positioned within the display case apparatus 80 such that the protrusion or post 6 of the spindle member 120 is inserted into the through hole 22 of the phonographic record 21.

Finally, the one or more attachment members 2 and 3 of the cover member 110 are aligned with the first and second cutout portions 15*a* and 15*b* of the base member 140 and then sliding, clicking and snapping the one or more attachment members 2 and 3 into place, thereby securing the cover member 110 onto the base member 140. As a result, the display case apparatus 80 creates a dust proof protective barrier around the phonographic record 21, while simultaneously allowing the user to have complete visibility of all sides of the phonographic record 21, except for one side.

Similarly, referring to FIG. 4, when the user desires to display a completely planar record cover or album 23, the base member 140 is first attached to a wall or other surface by inserting attachment members 19, such as screws or nails, into the plurality of cutouts 17 of the recess backwall 16*b*. Next, the base member 140 is shifted so as to lock the attachment members 19 within the plurality of cutouts 17 to thereby secure the base member 140 to the wall or other surface as desired.

Next, the display panel member 130 is then inserted within the recess member 16 and aligned using the plurality of protrusions and secured in order to affix the display panel member 130 to the base member 140, while hiding the attachment member 19 and the plurality of cutouts 17.

Next, the spindle member 120 is inserted into the cavity 10 of the display panel member 130 such that the second opposing side 8 having the planar surface faces away from the base member 140 (i.e., second orientation state) and the first side 51 having the protrusion or post 6 faces toward the base member 140.

Next, the completely planar record cover or album 23 is positioned within the display case apparatus 80 such that the second opposing side 8 having the planar surface is placed directly against the completely planar record cover or album 23.

Finally, the one or more attachment members 2 and 3 of the cover member 110 are aligned with the first and second cutout portions 15*a* and 15*b* of the base member 140 and then sliding, clicking and snapping the one or more attachment members 2 and 3 into place, thereby securing the cover member 110 onto the base member 140. As a result, the display case apparatus 80 creates a dust proof protective barrier around the phonographic record 21, while simultaneously allowing the user to have complete visibility of all sides of the phonographic record 21, except for one side.

The display case apparatus 80 according to the present general inventive concept allows the user to have improved visibility of the phonographic record 21 or the completely planar record cover or album 23 over conventional display cases by eliminating the need for a frame which often obstructs a line of sight to a record.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A display case apparatus for selectively displaying a phonograph record or album cover, comprising: a base member having a recess member formed therein; a display panel member detachably coupled within the recess member of the base member; a retractable spindle member coupled to the display panel member, the retractable spindle member having a state exposing a protrusion configured to fit within a hole of the phonograph record and a second state retracting the protrusion to configured to receive the album cover; and a cover member detachably coupled to the base member to protect items disposed on the spindle member.

2. The display case of claim 1, wherein the recess member is formed on a planar portion of the base member such that one or more sidewalls connect the planar portion to a bottom surface of the recess member.

3. The display case of claim 2, wherein the base member includes one or more cutout portions around a perimeter thereof.

4. The display case of claim 2, wherein the cover member includes one or more attachment members configured to be detachably coupled to the one or more cutout portions on the base member.

5. The display case of claim 2, wherein the cover member is formed of a transparent material to provide complete visibility to the phonograph record or album cover disposed on the spindle member from all angles.

6. The display case of claim 5, wherein the cover member forms a sealed compartment when coupled to the base member to protect items disposed therein from damage.

* * * * *